United States Patent [19]

Hasenour

[11] 4,020,771

[45] May 3, 1977

[54] EXTENDIBLE TABLE

[76] Inventor: James A. Hasenour, 821 Church Ave., Jasper, Ind. 47546

[22] Filed: Apr. 15, 1976

[21] Appl. No.: 677,428

[52] U.S. Cl. ..... 108/86
[51] Int. Cl.[2] ..... A47B 1/00
[58] Field of Search ..... 108/83, 84, 86, 89

[56] References Cited

UNITED STATES PATENTS

| | | | |
|---|---|---|---|
| 1,210,381 | 12/1916 | Moore | 108/84 |
| 1,915,347 | 6/1933 | Wurm | 108/84 |
| 2,205,274 | 6/1940 | Rastetter | 108/89 X |

FOREIGN PATENTS OR APPLICATIONS

| | | | |
|---|---|---|---|
| 505,806 | 9/1954 | Canada | 108/86 |

*Primary Examiner*—James C. Mitchell
*Attorney, Agent, or Firm*—Warren D. Flackbert

[57] ABSTRACT

An extendible table characterized, in one invention embodiment, by outwardly movable end sections which conceal a center or extension section at a non-extended position and which reveal the center section when at an extended position, the middle section being rotatable to present an upper surface which is coplanar with the upper surfaces of the end sections at the extended position. In another invention embodiment, the center section is vertically movable from the concealed position thereof, when the end sections are non-extended, to a position of use when the end sections are extended.

8 Claims, 14 Drawing Figures

EXTENDIBLE TABLE

As is known, it is desirable to provide a table which may be readily extended as the need arises. In this connection, and by way of example, the popular dining table affords more use in the instance of additional guests when the table can be extended. A common extension arrangement includes the addition of filler leaves, normally stored apart from the table, when the occasion so demands. Another extension arrangement is directed to pivotal leaves normally stored beneath the table top, but which become a part of the table top as the table is extended. A further arrangement, and more commonplace, is the conventional dropleaf table.

The invention affords a direct approach to a form of extendible table which is readily utilized and which, at the same time, provides a pleasing appearance, either when non-extended or extended. Briefly, the extendible table of the invention is defined by end sections, outwardly movable from the midline of the table, to reveal a normally concealed center or extension section. The end sections move on slider bars defined on the stationary framework of the table.

The center section is rotatable from the aforesaid concealed position to present a top surface which is coplaner with the top surface of each of the end sections. By moving the end sections towards the midline of the table, the center section is locked into an operative or use position, where the latter is achieved by reason of slider bars on the center section being in line with those on the stationary framework. In returning the table to a non-extended position, the converse of the preceding is accomplished, i.e., the end sections are moved outwardly, releasing the center section for rotating action and the return thereof to its concealed position when the end sections are returned to the closed position at the midline.

In another invention embodiment, and in contrast to the rotatable center or extension section, the center section is vertically movable in slots defined in the basic stationary framework of the table. In other words, the end sections are moved outwardly as in the first invention embodiment, revealing the center section, but then, in contrast, the center section is moved upwardly, so that top surfaces of the end sections and the center section are in the same plane.

The common basis underlying each of the described invention forms is the concealment of the center or extension section when the end sections are in a non-extended position. Thereafter, the center section is movable to a position of use or return to storage, either by rotating or by bidirectional movement.

The extendible table of the invention affords a pleasing appearance, preserving proper proportions when either extended or non-extended. In a preferred invention form, the table is made from metal channels which define the stationary and movable portions of the framework, where the table top is plate glass. Moreover, the extendible table herein may be employed for game purposes or needs other than the the mentioned dining.

A better understanding of the invention will become more apparent from the following description, taken in conjunction with the accompanying drawings, wherein FIG. 1 is a top plan view of an extendible table in accordance with the invention;

Figures 1, 2, 3:
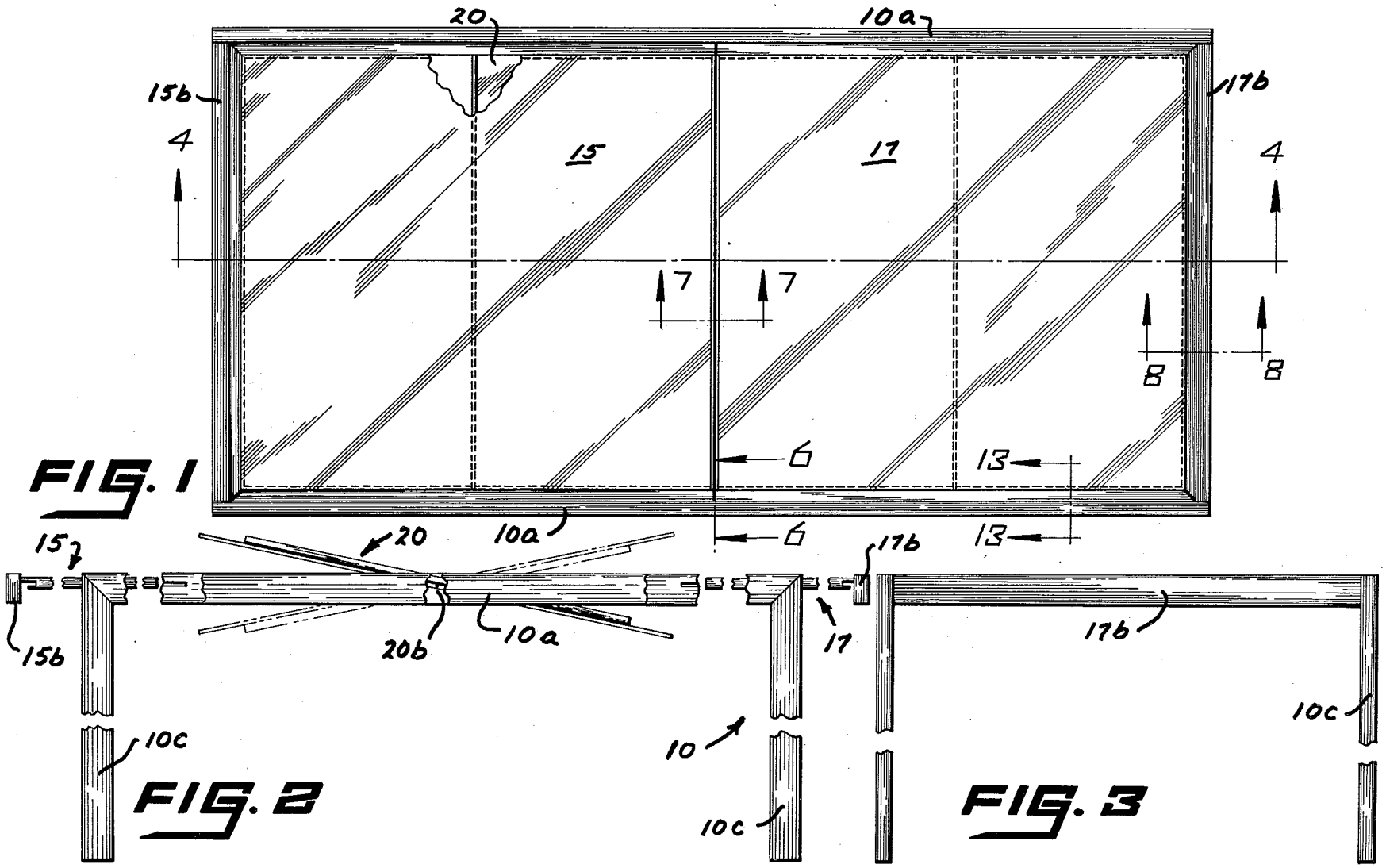
FIG. 2 is a view in side elevation, looking towards the bottom of FIG. 1, and partly fragmentary, where the table is in an extended position and the center section thereof is being rotated.
FIG. 3 is a view in end elevation, looking from right to left in FIG. 1, and also partly fragmentary, of the table.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications of the illustrated devices and such further applications of the principles of the invention as illustrated therein being contemplated as would normally occur to one skilled in the art to which the invention relates.

Referring now to the figures, the first embodiment of the extendible table of the invention includes a stationary framework 10 having side rails 10*a*, end rails 10*b* (see FIGS. 4 and 5) interconnecting side rails 10*a*, and supporting legs 10*c*. The stationary framework 10 mounts end sections 15 and 17 and, as well, a center or extension section 20.

Figures 4, 5, 6, 7, 8, 9, 10, 11:
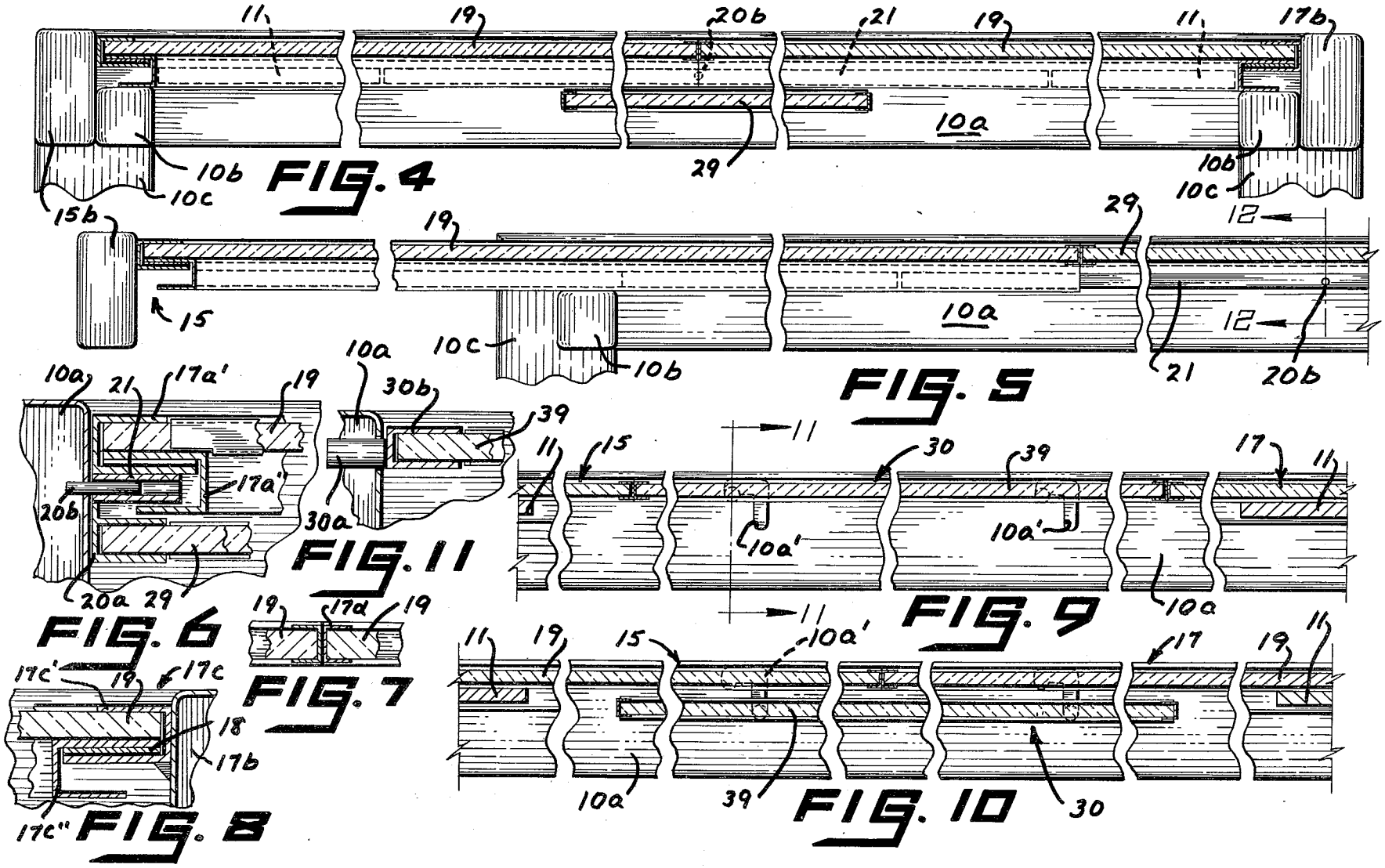
FIG. 4 is a view in vertical section, taken at line 4—4 on FIG. 1 and looking in the direction of the arrows.
FIG. 5 is another view in vertical section, comparing with the view of FIG. 4, but showing the table with an end section thereof at an extended position.
FIG. 6 is a detailed view in vertical section, taken at line 6—6 on FIG. 1 and looking in the direction of the arrows.
FIG. 7 is a detailed view in vertical section, taken at line 7—7 on FIG. 1 and looking in the direction of the arrows.
FIG. 8 is a detailed view in vertical section, taken at line 8—8 on FIG. 1 and looking in the direction of the arrows.
FIG. 9 is a view in vertical section, comparable with the view of FIG. 4, but showing an alternative invention embodiment.
FIG. 10 is a further view in vertical section, comparable with the view of FIG. 9, but showing the alternative invention embodiment in an extended position.
FIG. 11 is a detailed view of the positioning arrangement for the alternative invention embodiment of FIGS 9 and 10, taken at lines 11—11 on FIG. 9 and looking in the direction of the arrows.

As a matter of ready reference, FIGS. 4 and 5 are pertinent to the first invention form, i.e. an arrangement wherein the center or extension section 20 is rotatable, while FIGS. 9 and 10 are pertinent to a second invention form, i.e. where the movement of the center or extension section 20 is bidirectional, in this instance vertical.

In that each of the end sections 15 and 17 are the same, the discussion herein will be directed only to end section 17, the details of which are identified by appropriate cross-section lines. In this connection, and with reference to FIGS. 1 and 13, the side rails 10*a* of the stationary framework 10 are typically metal tubular members, each supporting, as by welding, a slider bar 11 along portions thereof. The slider bars 11 mount end section 17 for longitudinal movement, i.e. from right to left, and conversely, in FIG. 1.

More specifically, end section 17 includes, along each side edge, a clip assembly 17*a* defined by complementary inverted clip members 17*a'* and 17*a''* having a spacer 18 therebetween. The clip member 17*a'* receives table top 19, while the clip member 17*a''* receives the slider bar 11. In other words, the preceding arrangement permits longitudinal sliding movement of each end section 15 and 17 along the slider bars 11 on the stationary framework 10.

The end sections 17 each further include a cross rail 17*b* extending between the supporting legs 10*c* (see FIG. 3) and outside of the end rail 10*b* of the stationary framework 10. The relationship between cross rail 17*b*, end rail 10*b* and the supporting legs 10*c* is particularly evident in FIGS. 4 and 5.

With reference to FIG. 8, the cross rail 17*b* mounts a clip assembly 17*c* defined by complementary inverted clip members 17*c'* and 17*c''*, also having a spacer 18 therebetween. The clip assembly 17*c* is secured to the cross rail 17*b*, as by welding, for example. The table top 19 is received in space presented by the clip member 17*c'*. When the end section 17 is moved, as shown in FIG. 5, such movement is achieved by pulling or pushing cross rail 17*b* (or cross rail 15*b* in the instance of end section 15), causing the end section 17 to slide on the slider bars 11. The assembly is completed by a metal U-clip or facing 17*d* at the inner end edge of the table top 19, as evident in FIG. 7.

Referring now to FIGS. 2, 4, 5, 6, 12 and 14, the center or extension section 20 is rotatable from a position of non-use (the solid line representation in FIG. 2) to a position of use (the broken line representation in FIG. 2). In this connection, table top 29 of the center section 20 is coplaner with the table tops 19 of each of the end sections 15 and 17 when the table is in an extended position (see, for example, FIGS. 5 and 14) and is beneath the table tops 19 when in a stored position (see FIG. 4).

More particularly, the center or extension section 20, which is similarly arranged on each opposite side edge, includes a channel 20*a* which is adapted to receive the table top 29. The channel 20*a* is secured to a slider bar 21, as by welding, for example. A pivot pin 20*b* is located at the midpoint of each side of the center section 20, being driven into the slider bar 21 and extending into the tubular side rail 10*a* of the stationary framework 10.

It is important to note that the slider bar 21 and the slider bars 11 are in-line, being slightly spaced apart to permit the ready rotation of the center or extension section 20. The center section 20 also includes a U-type clip or facing 20*c* along the free end edges of the table top 29.

Figures 12, 13, 14:
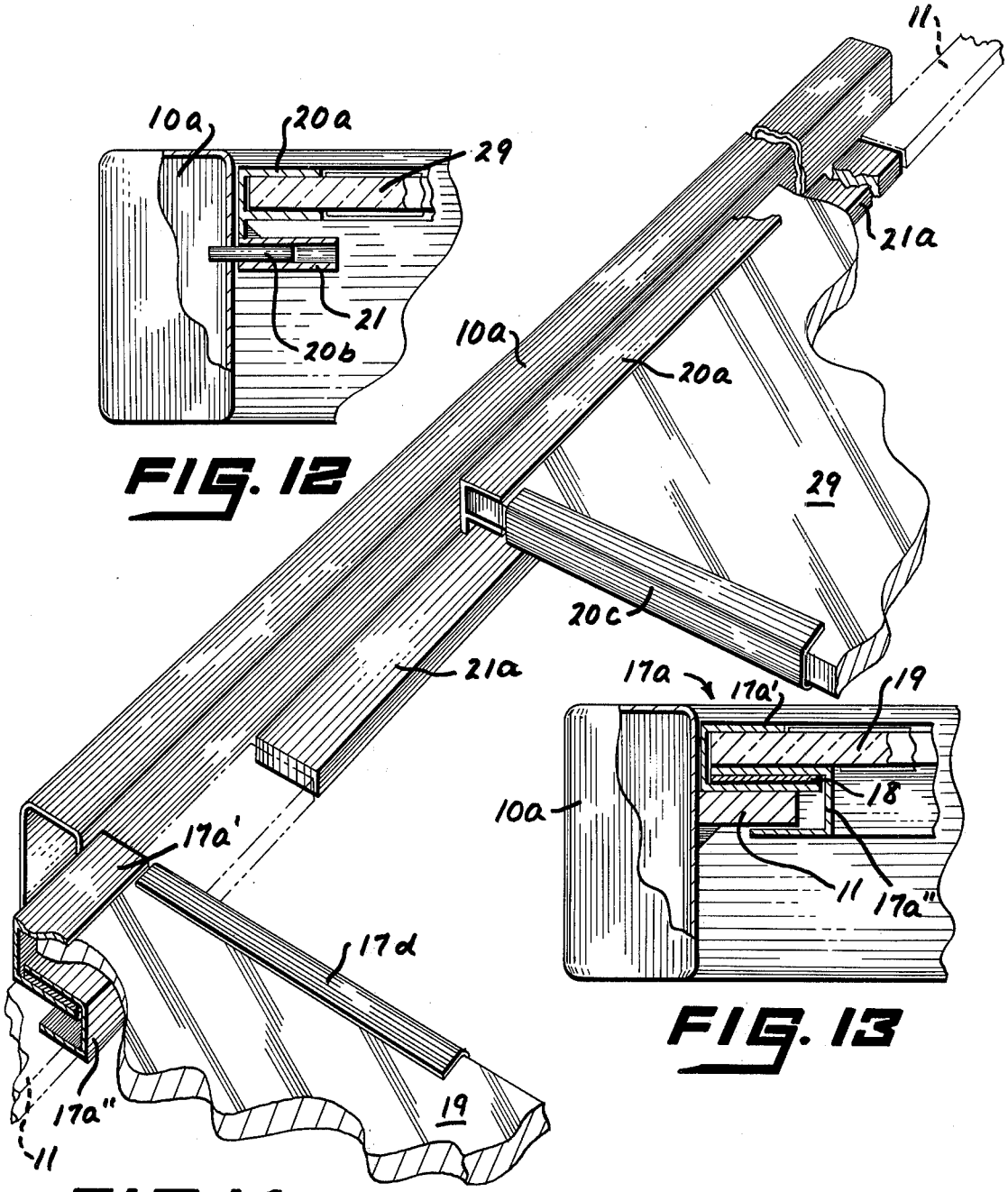
FIG. 12 is a view in vertical section showing the pivotal mounting arrangement for the first invention embodiment, taken at line 12—12 on FIG. 5 and looking in the direction of the arrows.
FIG. 13 is another vertical view, taken at line 13—13 on FIG. 1 and looking in the direction of the arrows; and, FIG. 14 is a perspective view showing the first invention embodiment after the center section has been rotated for use, but before either of the end sections has been moved to a closed position.

A study of FIGS. 6, 12 and 14 reveals, in detail, the dimensioning and/or geometry of the components for achieving the desired table usage. FIG. 6 (together with FIG. 4) shows the relationship of the center or extension section 20 and end sections 15 and 17 when the table is at a non-extended position. In this connection, the slider bars 11 and 21 are in alignment and the clip assembly 17*a* of end section 17 rides on a surface thereof. At this time, the channel 20*a* of the center or extension section 20 is at the stored or non-use position. In order to achieve the latter position, the center or extension section 20 is rotated 180° from the position of FIGS. 12 and 14.

When the end sections 15 and 17 are moved together at the midline of the table, the spacing between the channel 20*a* and the slider bar 21 receives a portion of the clip assembly 17*a* (see FIG. 6). The preceding is also apparent from FIG. 14 when the center or extension section 20 is rotated from the illustrated position.

It should further be evident from FIG. 14 that the slider bar 21 of the center section 20 extends beyond each end edge of the table top 29, at 21*a*, where such extending portion 21*a*, when the end sections 15 and 17 are closed towards each other, serves to stabilize or maintain the center section 20 in either the non-use or use positions. In any event, the table herein affords a pleasing appearance, characterized by proper proportioning, and provides ready and convenient use, when either extended or non-extended.

In the second invention embodiment, and as stated, the center or extension section, now identified by reference numeral 30, is movable from a stored or concealed position to a revealed or use position by reason of bilateral vertical movement. FIGS. 9, 10 and 11 illustrate such alternative relationship where, it should be understood, the structure of end sections 15 and 17 remain the same. In other words, the latter are still movable on the slider bars 11 affixed to the hollow side rails 10*a* of the stationary framework 10 (see FIG. 13), as in the first invention embodiment.

In the second invention embodiment, slots 10*a'* are defined on the inner surfaces of the side rails 10*a*. Slots 10*a'* each receive a pin 30*a* secured to a channel 30*b* which receives table top 39. The pin 30*a* and the center or extension section 30, moving together, are selectively disposed at an upper position providing an extended table (see FIG. 9), to a lower position, providing a non-extended position, or restated, a stored or concealed position.

In other words, by either raising or lowering action, the center or extension section 30 is readily moved to either permit the end sections 15 and 17 to come together for a non-extended table, or to be pulled apart so that the center or extension section 30 can be lifted for purposes of table extension use. In this latter connection, the end sections 15 and 17 are moved into abutting relationship with the end edges of the table top 39 (see FIG. 9).

From the preceding, it should be apparent that the invention provides an effective arrangement for achieving an extendible table, where the center or extension section is concealed when the end sections are closed upon each other, and conversely. In order to position the center or extension section for use, such is either rotated, or raised and lowered.

While the invention has been described in connection with metal frame members, such is adaptable to the use of wood or other material. Moreover, proportioning and/or dimensioning can be modified within the spirit of the invention. Thus, the preceding description should be considered illustrative and not as limiting the scope of the following claims:

I claim:

1. An extendible table comprising a stationary framework having side rails and end rails, first and second end sections mounted on said framework and movable from a non-extended position to an extended position, and a third section concealed beneath said first and second end sections at said non-extended position and movable within the confines of said side rails to a position between said first and second end sections when the latter are at said extended position, the ends of said third section being concealed by said side rails at said non-extended and said extended positions.

2. The extendible table of claim 1 where said first and second end sections and said third section have top surfaces coplaner with each other at said extended position.

3. The extendible table of claim 1 where said third section is moved vertically to said position between said first and second end sections.

4. The extendible table of claim 1 where said side rails each have mounting means, and where said third section is selectively supported by said mounting means.

5. The extendible table of claim 4 where said mounting means are slots.

6. An extendible table comprising a stationary framework having side rails and end rails, first and second end sections mounted on said framework and movable from a non-extended position to an extended position, and a third section concealed beneath said first and second end sections at said non-extended position and freely rotatable on an axis between said side rails to a position between said first and second end sections when the latter are at said extended position, the ends of said third section being concealed by said side rails at said non-extended and said extended positions.

7. The extendible table of claim 6 where said first and second end sections maintain said third section at said position therebetween.

8. The extendible table of claim 6 where said side rails having slider bars along portions thereof, and where said third section has slider bars which are in-line with said slider bars on said stationary framework both at said concealed position of said third section and at said position of said third section between said first and second end sections.

* * * * *